US005156088A

United States Patent [19]

Tohdo

[11] Patent Number: 5,156,088

[45] Date of Patent: Oct. 20, 1992

[54] METHOD AND APPARATUS FOR AUTOMATICALLY PRINTING ON FOUR SIDES OF BOX SHAPED OBJECT

[76] Inventor: Michiharu Tohdo, 7-34, Miyazaki 6-chome, Miyamae-ku, Kawasaki-shi, Kanagawa-ken, Japan, JPX

[21] Appl. No.: 695,640

[22] Filed: May 3, 1991

[30] Foreign Application Priority Data

May 11, 1990 [JP] Japan ..... 2-120041

[51] Int. Cl.[5] ..... B41F 17/00; B41F 17/24

[52] U.S. Cl. ..... 101/35; 101/483

[58] Field of Search ..... 101/35, 36, 37, 43, 101/44, 483

[56] References Cited

U.S. PATENT DOCUMENTS

| | | | |
|---|---|---|---|
| 2,664,816 | 1/1954 | Gibson | 101/37 |
| 2,761,545 | 9/1956 | Hoagland | 101/37 X |
| 2,834,285 | 5/1953 | Gottscho | 101/35 |
| 3,867,882 | 2/1975 | Ahlgren et al. | 101/35 |
| 4,455,935 | 6/1984 | Manz et al. | 101/35 |

FOREIGN PATENT DOCUMENTS

| | | | |
|---|---|---|---|
| 0046474 | 8/1980 | European Pat. Off. | 101/35 |

*Primary Examiner*—Clifford D. Crowder
*Attorney, Agent, or Firm*—Marger, Johnson, McCollom & Stolowitz

[57] ABSTRACT

A method and an apparatus for printing at desired positions on four sides of a box shaped object of an arbitrary size, automatically, quickly, without complicating a configuration of the apparatus excessively. In the apparatus, carrier rollers are rotated in a normal direction in order to place the box shaped object at a predetermined printing position on the carrier passage; one corner of the box shaped object at a predetermined printing position on the carrier passage is held by a holding mechanism; desired printing patterns are printed on one side of the box shaped object facing toward the printer by printer; the carrier rollers are forcefully stopped while the printer prints on one side of the box shaped object facing toward the printer; the carrier rollers are rotated in a reverse direction such that the box shaped object is rotated by 90°, by obliquely arranged members of the carrier rollers which are arranged along the printer in an orientation oblique to the carrier passage, around the corner of the box shaped object held by the holding mechanism; and the holding mechanism is released from said one corner of the box shaped object after the box shaped object is rotated by 90°.

20 Claims, 5 Drawing Sheets

METHOD AND APPARATUS FOR AUTOMATICALLY PRINTING ON FOUR SIDES OF BOX SHAPED OBJECT

BACKGROUND OF THE INVENTION

1. Field of the Invention

The present invention relates to a printing apparatus for printing directly on a box shaped object carried along a carrier passage.

2. Description of the Background Art

In a case of printing four sides of a box shaped object such as a cardboard box directly at a carrier passage along which the box shaped object is carried, it has been necessary conventionally to stop the box shaped object by a stopper provided at a predetermined position on the carrier passage in order to print on one side of the box shaped object at that position, then to turn the box shaped object by 90° manually in order to print on another side of the box shaped object, and so on.

However, this type of a conventional printing apparatus requires cumbersome manual operations for turning the box shaped object to be carried out by an attendant worker, so that the efficiency of the printing process has inevitably been low.

Also, it has been possible conventionally to provide two printers on both sides of the carrier passage such that two opposing sides of the box shaped object can be printed simultaneously by stopping the box shaped object by a stopper provided at a predetermined position on the carrier passage, then to turn the box shaped object by 90° manually in order to print on another two opposing sides of the box shaped object simultaneously.

However, this type of a conventional printing apparatus also requires cumbersome manual operation for turning the box shaped object to be carried out by an attendant worker, so that the efficiency of the printing process has also inevitably been low. Moreover, in this type of a conventional printing apparatus, when the adjacent sides of the box shaped object have different lengths, it is necessary to adjust the width of the carrier passage according to a size of the box shaped object while turning the box shaped object by 90°. Furthermore, in this type of a conventional printing apparatus, the printing positions by the printers are fixed, so that it has been impossible to automatically provide the printing at desired positions for a number of box shaped objects of different sizes carried along the carrier passage in an arbitrary order.

Also, it has been possible conventionally to provide a turning mechanism at a predetermined position on the carrier passage such that one side of the box shaped object is printed by stopping the box shaped object by a stopper provided at a predetermined position on the carrier passage, then another side of the box shaped object is printed by turning the box shaped object by 90° with the turning mechanism on the carrier passage, and so on.

However, this type of a conventional printing apparatus has a drawback of being quite complicated in configuration and expensive in cost because of the additional feature of the turning mechanism. Moreover, in this type of a conventional printing apparatus, the size of the box shaped object that can be handled by a particular turning mechanism is limited within a certain range, so that it has been necessary to change the turning mechanism according to the size of the box shaped object to be handled in order to deal with box shaped objects of different sizes.

SUMMARY OF THE INVENTION

It is therefore an object of the present invention to provide a printing method and a printing apparatus for printing at desired positions on four sides of a box shaped object of an arbitrary size, automatically, quickly, without complicating a configuration of the apparatus excessively.

According to one aspect of the present invention there is provided a printing apparatus for printing on a box shaped object carried along a carrier passage, comprising: printer means for printing desired printing patterns on the box shaped object at a predetermined printing position on the carrier passage; carrier rollers forming the carrier passage which are capable of being rotated in both normal and reverse directions and being forcefully stopped, including obliquely arranged members for carrying and rotating the box shaped object on the carrier passage, the obliquely arranged rollers being arranged along the printer means in an orientation oblique to the carrier passage; holding mechanism capable of holding one corner of the box shaped object at the predetermined printing position on the carrier passage; and control means for controlling operations of the printer means, carrier rollers, and holding mechanism.

According to another aspect of the present invention there is provided a method of printing on a box shaped object carried along a carrier passage, comprising the steps of: (a) rotating carrier rollers in a normal direction in order to place the box shaped object at a predetermined printing position on the carrier passage; (b) holding one corner of the box shaped object at the predetermined printing position on the carrier passage by a holding mechanism; (c) printing desired printing patterns by printer means on one side of the box shaped object facing toward the printer means; (d) forcefully stopping the carrier rollers while the printer means prints on one side of the box shaped object facing toward the printer means; (e) rotating the carrier rollers in a reverse direction such that the box shaped object is rotated by 90°, by obliquely arranged members of the carrier rollers which are arranged along the printer means in an orientation oblique to the carrier passage, around said one corner of the box shaped object held by the holding mechanism; and (f) releasing the holding mechanism from said one corner of the box shaped object after the box shaped object is rotated by 90°.

Other features and advantages of the present invention will become apparent from the following description taken in conjunction with the accompanying drawings.

DETAILED DESCRIPTION OF THE PREFERRED EMBODIMENTS

Figure 1:
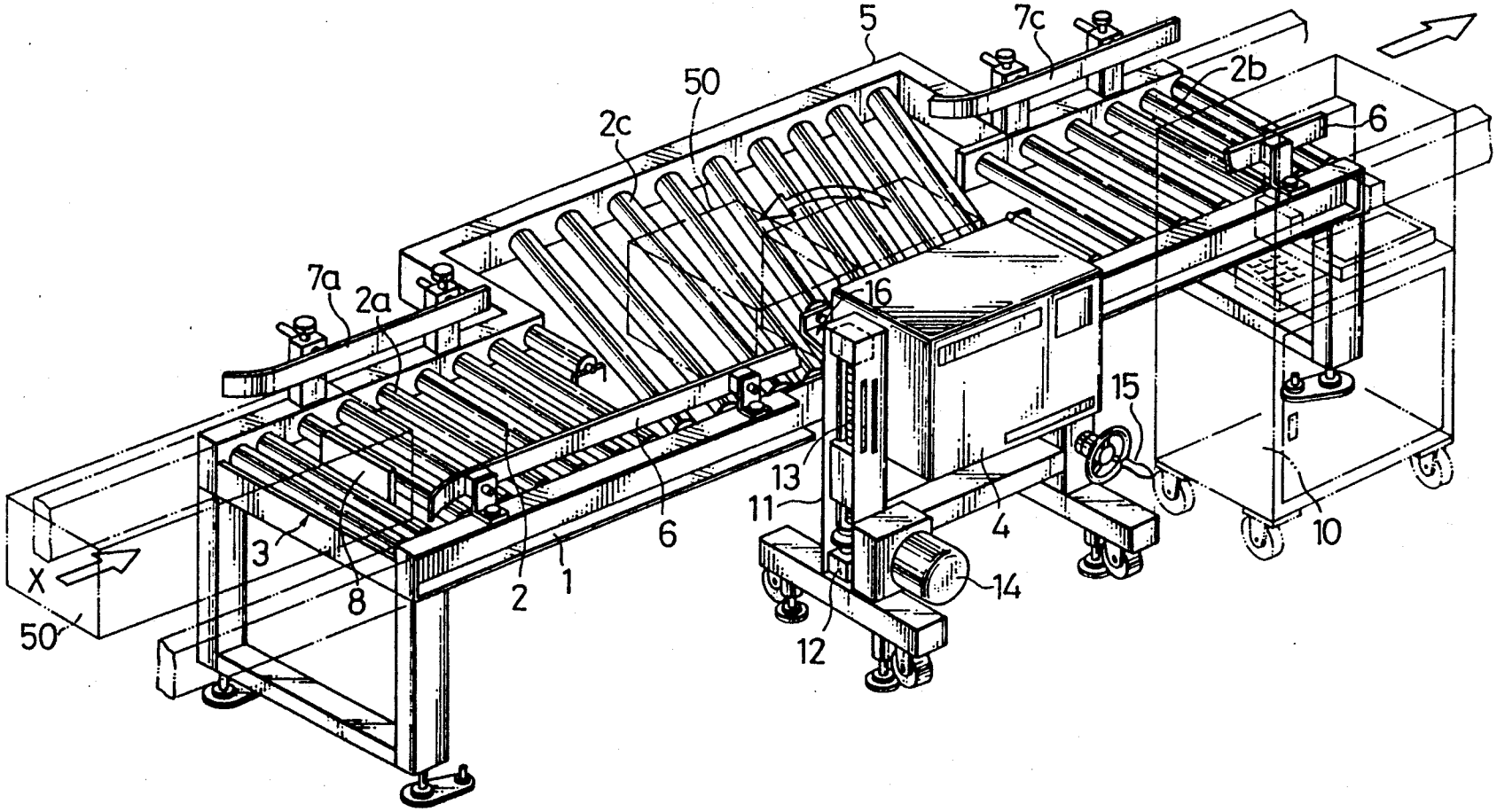
FIG. 1 is a perspective view of one embodiment of a printing apparatus according to the present invention.

Referring now to FIG. 1, one embodiment of a printing apparatus according to the present invention will be described in detail.

In this embodiment, the printing apparatus comprises: a frame 1 having a middle section 5 in which a width is widened toward a back side; a plurality of carrier rollers 2 capable of rotating in both normal and reverse directions by being driven by a motor (not shown) which form a carrier passage 3 for carrying a box shaped object 50 along an X direction; a printer unit 4 located on a front side of the frame 1 at an approximate middle of the frame 1 along the middle section 5; and a control unit 10 located by the printer unit 4 for controlling the operations of the carrier rollers 2 and the printer unit 4.

The carrier rollers 2 includes: inlet rollers 2*a* arranged along the X direction on the left end section of the frame 1 with each roller having a rotational axis lying along a direction perpendicular to the X direction, by which the box shaped object 50 can be sent in; outlet rollers 2*b* arranged along the X direction on the right end section of the frame 1 with each roller having a rotational axis lying along a direction perpendicular to the X direction, by which the box shaped object 50 can be sent out; and oblique middle section rollers 2*c* arranged at the middle section 5 of the frame 1 with each roller having a rotational axis lying obliquely such that its back side end is positioned closer to the outlet rollers 2*b* side than its front side end and its front side end is positioned closer to the inlet rollers 2*a* side than its back side end. In other words, each of the middle section rollers 2*c* has a rotational axis lying obliquely with respect to the carrier passage 3, such that one end of the rotational axis located away from the printer unit 4 is displaced toward the direction X in which the box shaped object 50 is carried than another end of the rotational axis located nearby the printer unit 4.

The frame 1 is further equipped with: a front guide rail 6 on its front side edge; an inlet side back guide rail 7*a* on its back side edge along the inlet rollers 2*a*; an outlet side back guide rail 7*b* on its back side edge along the outlet rollers 2*b*; and a stopper plate 8 operated under the control of the control unit 10, located at the left end of the carrier passage 3, for temporarily stopping the box shaped object 50 from being sent into the carrier passage 3.

The printer unit 4 is supported by support members 11 mounted on a base frames 12 located on a floor, where a vertical printing position of the printer unit 4 with respect to the frame 1 is made adjustable by using a screw 13 provided within the support members 11 which is turned by either a motor 14 operating under the control by the control unit 10 or a handle 15 to be manually operated. The printer unit 4 has a dot printer head of 4 dots/mm resolution for example, which is controlled by the control unit 10 to print desired print patterns on the box shaped object 50.

Figure 2:
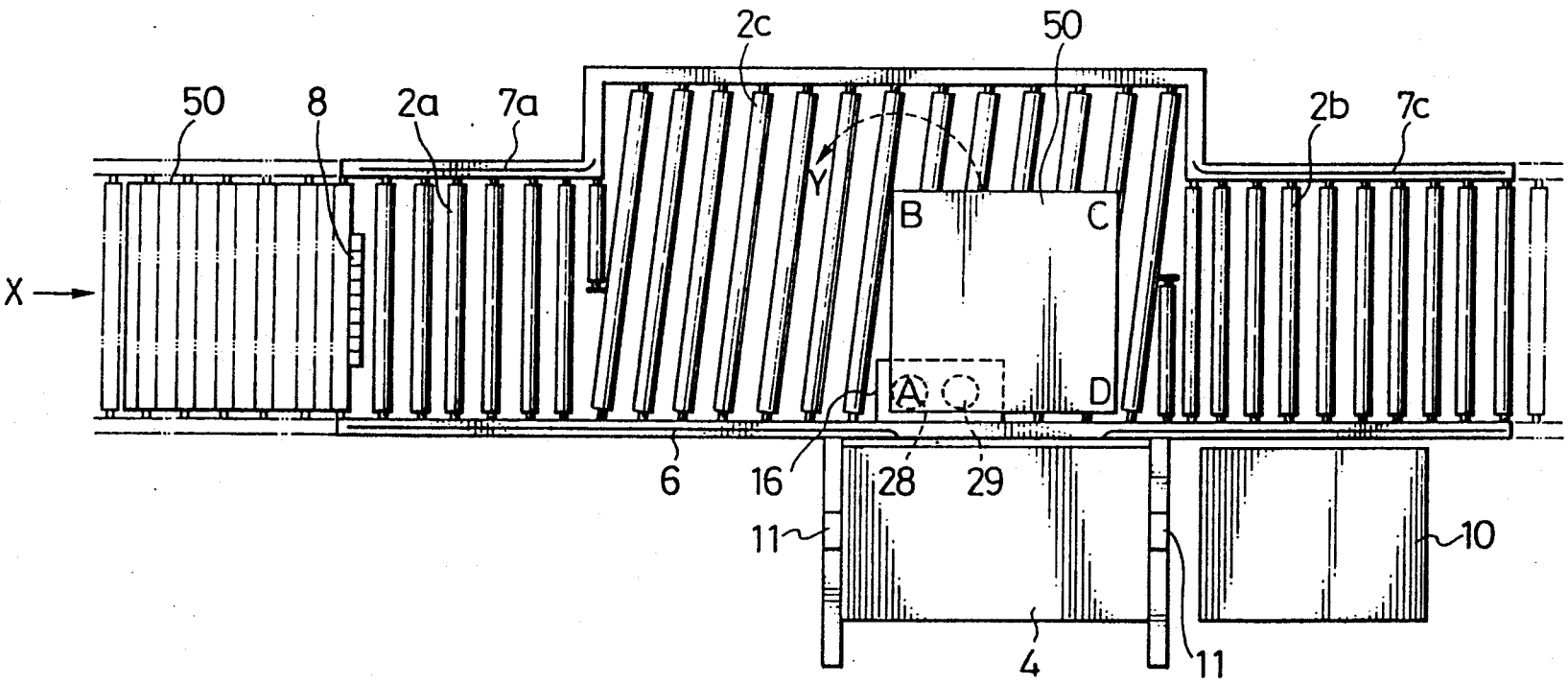
FIG. 2 is a schematic top plan view of the printing apparatus of FIG. 1 for explaining its operation.
Figure 3:
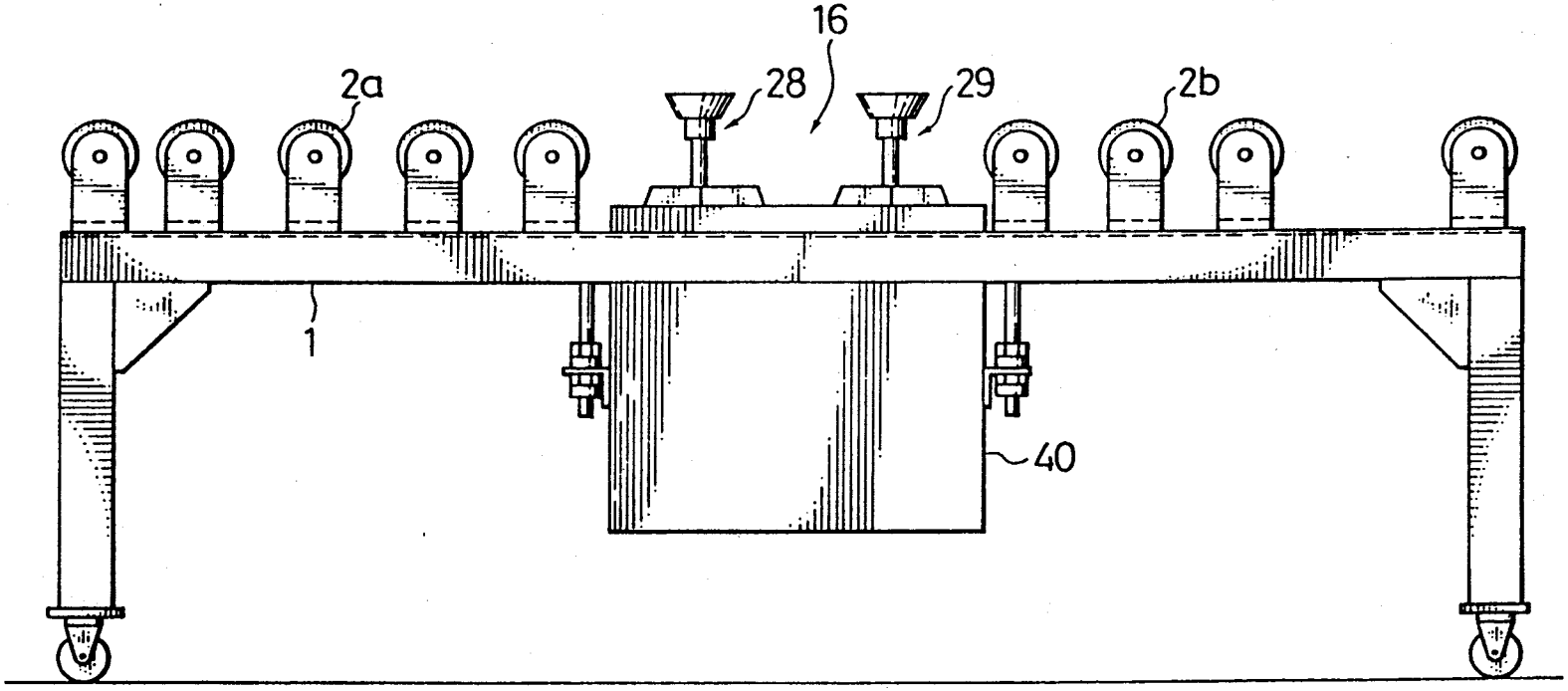
FIG. 3 is a schematic side view of the printing apparatus of FIG. 1 for showing a configuration of a holding mechanism of the printing apparatus of FIG. 1.

In addition, at a position on the carrier passage 3 along the front side edge of the frame 1 in the middle section 5 which is adjacent to the printer unit 4, there is provided a holding mechanism unit 16, as shown in FIGS. 2 and 3.

Figure 4:
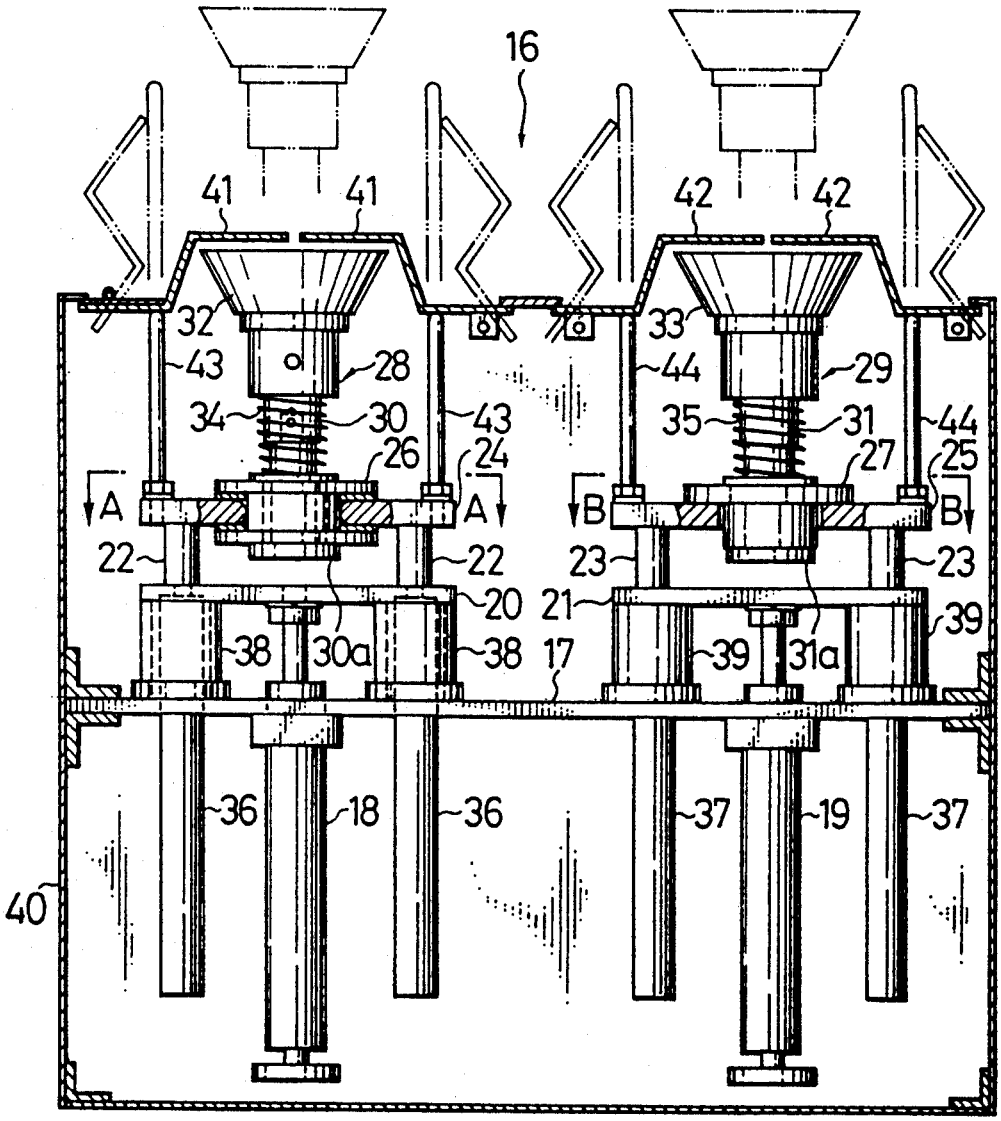
FIG. 4 is a side view of a detail inner configuration of a holding mechanism of the printing apparatus of FIG. 1.

As shown in FIG. 4, this holding mechanism unit 16 comprises: a pair of air cylinders 18 and 19 attached to a support plate 17; a pair of guide plates 20 and 21 which are capable of moving vertically by being driven by the air cylinders 18 and 19, respectively; a pair of mounting plates 24 and 25 fixed on the guide plates 20 and 21, respectively, through four fixing members 22 provided on four corners of the mounting plate 24 and four fixing members 23 provided on four corners of the mounting plate 25; a pair of flanges 26 and 27 rotatably mounted on the mounting plates 24 and 25, respectively; and a pair of sucking disks 32 and 33 rotatably supported on the mounting plates 24 and 25, respectively, through the flanges 26 and 27.

The guide plates 20 and 21 have guide rods 36 and 37, respectively, attached on their bottom faces, which are slidable in a vertical direction through guide bushings 38 and 39, respectively, attached on the support plate 17.

The sucking disk 28 comprises a support rod 30 rotatably supported by the flange 26, and a cup shaped head portion 32 made of an elastic material such as rubber which is attached at a top of the support rod 30. A bottom end of the support rod 30 has a flanged portion 30*a*, and a coil spring 34 is provided between a bottom face of the head portion 32 and a top face of the flange 26. Similarly, the sucking disk 29 comprises a support rod 31 rotatably supported by the flange 27, and a cup shaped head portion 33 made of an elastic material such as rubber which is attached at a top of the support rod 31. A bottom end of the support rod 31 has a flanged portion 31*a*, and a coil spring 35 is provided between a bottom face of the head portion 33 and a top face of the flange 27.

Figure 5:
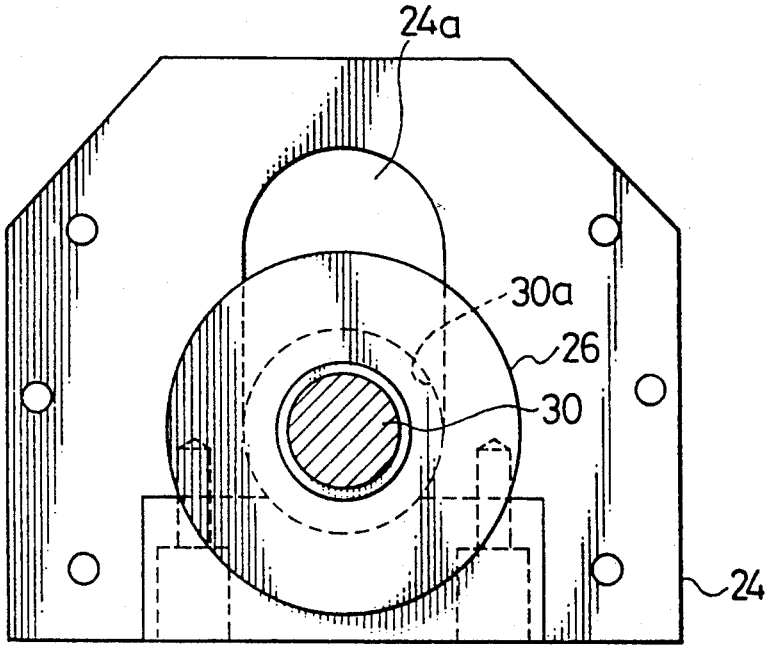
FIG. 5 is a top plan view of a mounting plate in the holding mechanism of FIG. 4.
Figure 6:
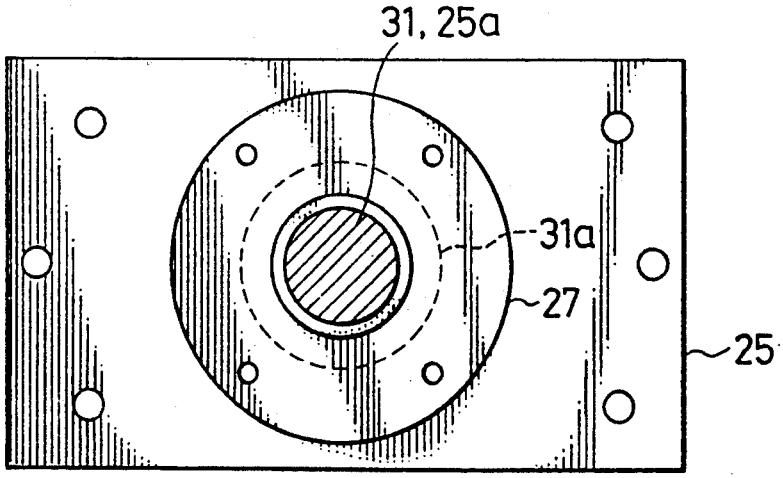
FIG. 6 is a top plan view of another mounting plate in the holding mechanism of FIG. 4.

As shown in FIG. 5, the mounting plate 24 has an elongated guide hole 24*a* in which the flange 26 is attached to be rotatable and slidable along the elongated guide hole 24*a*, while as shown in FIG. 6, the mounting plate 25 has a circular guide hole 25*a* in which the flange 27 is attached to be rotatable.

This holding mechanism unit 16 is enclosed by a case 40 which has openable covers 41 and 42 in correspondence to the sucking disks 28 and 29, respectively, such that the covers 41 and 42 close over the head portions 32 and 33 of the sucking disks 28 and 29 in their lowered positions, while the covers 41 and 42 are pushed up by rods 43 and 44 attached on the mounting plates 24 and 25 so as to open when the sucking disks 28 and 29 are raised.

Now, the operation of this printing apparatus will be described.

First, after the power for the apparatus is turned on, the desired printing patterns are inputted to the control unit 10 from a host computer (not shown) or a keyboard (not shown). Then, the stopper 8 is lowered, such that one box shaped object 50 stopped by the stopper 8 is released onto the carrier passage 3.

The released box shaped object 50 is then carried along the X direction by the inlet rollers 2*a* rotating in the normal direction, and subsequently abutted against the front guide rail 6 by the middle section rollers 2*c* rotating in the normal direction.

Next, a sensor (not shown) detects the box shaped object 50 at a predetermined printing position on the carrier passage 3 located over the holding mechanism unit 16 in front of the printer unit 4, and in response a brake to forcefully stop the rotation of the carrier rollers 2 is applied to the carrier rollers 2 by the control unit 10 such that the box shaped object 50 can be positioned at the predetermined printing position.

Then, the screw 13 is operated by the motor 14 under the control of the control unit 10, such that the printer unit 4 is automatically moved to a desired printing position on a side of the box shaped object 50 detected by a sensor (not shown) associated with the printer unit 4.

Next, the air cylinders 18 and 19 of the holding mechanism unit 16 are automatically operated such that the sucking disks 28 and 29 are moved upwards by the guide plates 20 and 21, until the head portions 32 and 33 are attached to the bottom face of the box shaped object 50 and the support rods 30 and 31 are pushed back against the coil springs 34 and 35. Here, as shown in FIG. 2, the sucking disk 28 is attached at the corner A of the box shaped object 50 while the sucking disk 29 is attached at the side AD of the box shaped object 50.

Then, in this state in which the box shaped object 50 is held at the predetermined printing position by the holding mechanism unit 16, the printer unit 4 is operated under the control by the control unit 10 such that the desired printing patterns are printed on the side AD of the box shaped object 50 at the desired printing position. Here, the printer unit 4 may be controlled to print at more than one positions on the single side of the box shaped object 50, if necessary.

When the printing by the printer unit 4 on the side AD of the box shaped object 50 is finished, the printer unit 4 is lowered to its initial position.

Then, the air cylinder 19 is operated by the control unit 10 such that the sucking disk 29 is released from the bottom face of the box shaped object 50, and at the same time, the carrier rollers 2 are controlled by the control unit 10 to rotate in the reverse direction such that the box shaped object 50 is rotated by 90° in a direction Y shown in FIG. 2 around the sucking disk 28 by the middle section rollers **2*c* rotating in the reverse direction. In other words, the box shaped object 50 is rotated in the Y direction around the corner A until the side AB abuts the front guide rail 6. Here, the flange 26 supporting the sucking disk 28 is attached to the mounting plate 24 at the elongated guide hole 24*a* to be slidable and rotatable, so that the displacement of the box shaped object 50 due to the abutment of the edge of the corner A against the front guide rail 6 can be absorbed by the sliding motion of the flange 26 along the elongated hole 24*a***.

Next, the air cylinder 18 is operated by the control unit 10 such that the sucking disk 28 is also released from the bottom face of the box shaped object 50, and at the same time, the carrier rollers 2 are controlled by the control unit 10 to rotate in the normal direction such that the box shaped object 50 is positioned to the predetermined printing position on the carrier passage 3 again, as in a manner described above.

Then, the printing by the printer unit 4 on the side AB of the box shaped object 50 is carried out in a manner similar to that described above for the printing of the side AD.

The printing on four sides of the box shaped object 50 can be completed by repeating the similar procedure for the remaining sides BC and CD of the box shaped object 50.

Finally, when the printing by the printer unit 4 on the four sides of the box shaped object 50 is finished, the box shaped object 50 is sent out along the X direction by the outlet rollers **2*b*** rotating in the normal direction.

Thus, according to the printing apparatus of the this embodiment, the printing at desired positions on four sides of the box shaped object 50 can be achieved automatically and quickly, without manual operations by an attendant worker, by appropriately controlling the carrier rollers 2, the holding mechanism unit 16, and the printer unit 4 as described in detail above.

Moreover, according to the printing apparatus of the this embodiment, the printing at the desired positions on each side of the box shaped object 50 of an arbitrary size can be achieved automatically and quickly by appropriately controlling the vertical position of the printer unit 4 with the control unit 10.

Furthermore, according to the printing apparatus of the this embodiment, the printing at desired positions on four side of the box shaped object 50 of an arbitrary size can be achieved automatically and quickly, without complicating a configuration of the apparatus excessively, by using only the carrier rollers 2, the holding mechanism unit 16, and the printer unit 4.

It is to be noted that many modifications and variations of the above embodiment may be made without departing from the novel and advantageous features of the present invention. Accordingly, all such modifications and variations are intended to be included within the scope of the appended claims.

What is claimed is:

1. A printing apparatus for printing on a box shaped object carried along a carrier passage, comprising:

printer means for printing desired printing patterns on the box shaped object at a predetermined printing position on the carrier passage;

carrier rollers forming the carrier passage, including obliquely arranged reversibly-driven members for carrying and rotating the box shaped object on the carrier passage, the obliquely arranged members being arranged along the printer means in an orientation oblique to the carrier passage; and holding means for holding which is controlled to hold one corner of the box shaped object at the predetermined printing position on the carrier passage; and control means for controlling the carrier rollers and holding means sequentially to drive the obliquely arranged members in a normal direction and thereby infeed the box shaped object to the printing position for the printing means to print thereon, to actuate the holding means to hold said one corner, and to drive the obliquely arranged members in a reverse direction and thereby rotate the object on the carrier passage.

2. The printing apparatus of claim 1, wherein the obliquely arranged members are rollers oriented at a non-normal angle to the carrier passage such that the box shaped object is thrusted toward the printer means when the carrier rollers are rotated in the normal direction, and the box shaped object is rotated around said one corner of the box shaped object held by the holding mechanism when the carrier rollers are rotated in the reverse direction.

3. The printing apparatus of claim 1, wherein each of the obliquely arranged members has a rotational axis lying obliquely with respect to the carrier passage, such that one end of the rotational axis located relatively away from the printer means is displaced toward a direction in which the box shaped object is carried than another end of the rotational axis located relatively nearby the printer means.

4. The printing apparatus of claim 1, including printer adjustment means for moving the printer means in a vertical direction with respect to the carrier passage.

5. The printing apparatus of claim 4, wherein the control means controls the printer adjustment means to move the printer means in the vertical direction according to a size of the box shaped object such that the printer means prints at desired position on the box shaped object.

6. The printing apparatus of claim 1, wherein the control means includes means for braking the carrier rollers such that the carrier rollers carrying the box shaped object along the carrier passage are forcefully stopped at the predetermined printing position.

7. The printing apparatus of claim 1, wherein the holding mechanism including slide means for absorbing a displacement of said one corner of the box shaped object in a direction perpendicular to the carrier passage while the box shaped object is rotated by the obliquely arranged members of the carrier rollers.

8. The printing apparatus of claim 1, further including a second holding means for holding a bottom face of the box shaped object located at the predetermined printing position along one side of the box shaped object.

9. The printing apparatus of claim 8, wherein the control means includes means for actuating the second holding means to hold the bottom face of the box shaped object located at the predetermined printing position along said one side of the box shaped object only while the printer means prints on the box shaped object.

10. The printing apparatus of claim 1, wherein, with respect to each one of four sides of the box shaped object, the control means includes means for repeating a control sequence of: a printing operation of the printer means, rotation and stopping of the carrier rollers, and a holding operation of the holding means in a sequence such that the carrier rollers are controlled to be rotated in the normal direction in order to place the box shaped object at the predetermined printing position on the carrier passage; the holding means is controlled to hold said one corner of the box shaped object at the predetermined printing position on the carrier passage; the printer means is controlled to print on one side of the box shaped object facing toward the printer means; the carrier rollers are controlled to be forcefully stopped while the printer means prints on one side of the box shaped object facing toward the printer means; the carrier rollers are controlled to be rotated in the reverse direction in order to rotate the box shaped object by 90° around said one corner of the box shaped object held by the holding means; and the holding means is controlled to release said one corner of the box shaped object after the box shaped object is rotated by 90°.

11. The printing apparatus of claim 1, wherein the control means includes means for actuating the printer means to print a side of the box shaped object when the holding means is actuated to hold the corner thereof.

12. A printing apparatus according to claim 1 including:

control means including first means for controlling a printing operation of the printer means, second means for controlling rotation and stopping of the carrier rollers, and third means for controlling a holding operation of the holding means such that the box shaped object is carried to the predetermined printing position as the carrier rollers are controlled to be rotated in a normal direction, the printer means prints one side of the box shaped object as the holding means is controlled to hold the one corner of the box shaped object at the predetermined printing position while the carrier roller is controlled to be forcefully stopped, and the printer means prints another side of the box shaped object after the box shaped object is rotated as the holding means is controlled to hold the one corner of the box shaped object at the predetermined printing position while the carrier roller is controlled to be rotated in a reverse direction and the box shaped object is carried to the predetermined printing position as the holding means is controlled to release the one corner of the box shaped object while the carrier rollers are controlled to be rotated in a normal direction.

13. A method of printing on a box shaped object carried along a carrier passage, comprising the steps of:

(aO) positioning carrier rollers so as to define a carrier passage adjoining a printer, including obliquely arranged members for carrying and rotating the box shaped object in the carrier passage, the obliquely arranged members being arranged alongside the printer in an orientation oblique to the carrier passage;

(a) rotating the carrier rollers in a normal direction in order to place the box shaped object at a predetermined printing position on the carrier passage;

(b) holding one corner of the box shaped object at the predetermined printing position on the carrier passage by a holding mechanism;

(c) printing desired printing patterns by printing means on one side of the box shaped object facing toward the printer;

(d) forcefully stopping the carrier rollers while the printer means prints on one side of the box shaped object facing toward the printer;

(e) rotating the carrier rollers in a reverse direction such that the box shaped object is rotated by 90° by the obliquely arranged members of the carrier rollers around said one corner of the box shaped object held by the holding mechanism; and (f) releasing the holding mechanism from said one corner of the box shaped object after the box shaped object is rotated by 90°.

14. The printing method of claim 13, wherein the positioning step (aO) includes orienting the obliquely arranged members of the carrier rollers at an angle to the carrier passage such that the box shaped object is thrusted toward the printer means when the carrier rollers are rotated in the normal direction, and the box shaped object is rotated around said one corner of the box shaped object held by the holding mechanism when the carrier rollers are rotated in the reverse direction.

15. The printing method of claim 13, wherein the positioning step (aO) includes orienting each of the obliquely arranged members to rotate about an axis lying obliquely with respect to the carrier passage, such that one end of the rotational axis located relatively away from the printer means is displaced toward a direction in which the box shaped object is carried than another end of the rotational axis located relatively nearby the printer means.

16. The printing method of claim 13, wherein at the step (c), the printer is moved in a vertical direction with respect to the carrier passage according to a size of the box shaped object such that the printer prints at a desired position on the box shaped object.

17. The printing method of claim 13, wherein at the step (e), a displacement of said one corner of the box shaped object in a direction perpendicular to the carrier passage while the box shaped object is rotated by the obliquely arranged members of the carrier rollers is absorbed by slide means incorporated in the holding mechanism.

18. The printing method of claim 13, wherein the step (b) further includes holding of a bottom face of the box shaped object located at the predetermined printing position along one side of the box shaped object by another holding mechanism.

19. The printing method of claim 18, wherein the step (e) further includes releasing of said another holding mechanism from said bottom face of the box shaped object before the box shaped object is rotated by 90°.

20. The printing method of claim 13, wherein a sequence of the steps (a) to (f) is repeated with respect to each one of four sides of the box shaped object.

* * * * *